US008033880B2

(12) United States Patent
Suzuki et al.

(10) Patent No.: US 8,033,880 B2
(45) Date of Patent: Oct. 11, 2011

(54) METHOD FOR MANUFACTURING SPARK PLUG

(75) Inventors: Akira Suzuki, Nagoya (JP); Mai Nakamura, Inazawa (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 68 days.

(21) Appl. No.: 12/702,642

(22) Filed: Feb. 9, 2010

(65) Prior Publication Data

US 2010/0203791 A1 Aug. 12, 2010

(30) Foreign Application Priority Data

Feb. 10, 2009 (JP) ..... 2009-028462

(51) Int. Cl.
*H01T 21/02* (2006.01)

(52) U.S. Cl. ..... 445/7; 445/1

(58) Field of Classification Search ..... 445/1, 7
See application file for complete search history.

(56) References Cited

U.S. PATENT DOCUMENTS 4,871,339 A * 10/1989 Sadegh ..... 445/7
6,538,365 B2 * 3/2003 Nasu et al. ..... 313/118
2002/0041135 A1 4/2002 Fukushima
2002/0193033 A1 * 12/2002 Nasu et al. ..... 445/7

FOREIGN PATENT DOCUMENTS

JP 2007-141868 A 6/2007

* cited by examiner

*Primary Examiner* — Nimeshkumar Patel
*Assistant Examiner* — Glenn Zimmerman
(74) *Attorney, Agent, or Firm* — Sughrue Mion, PLLC

(57) ABSTRACT

A method for manufacturing a spark plug which includes: (a) preparing a metal shell; (b) preparing an insulator; (c) inserting the insulator in an insertion hole of the metal shell; (d) forming an intended crimping portion of the metal shell into a crimping portion; and (e) pressing a lower side portion of the metal shell closer to a position lower than the intended compressive deformation portion, and pressing the crimping portion of the metal shell in an axial direction to compressively deform the intended compressive deformation portion of the metal shell and thus seal a space between a stepped portion of the metal shell and a stepped portion of the insulator, wherein step (e) controls a pressing amount of a press in a constant value from the start of compressive deformation to the end thereof.

9 Claims, 6 Drawing Sheets

430
440
50
51
55
52
15
8
56
18
53
6
9
7
4
19
BC
58
58a
435
54
445
O
ΔB

METHOD FOR MANUFACTURING SPARK PLUG

BACKGROUND OF THE INVENTION

1. Field of the Invention

The present invention relates to a method for manufacturing a spark plug, and to apparatus and devices adapted for practicing the method.

2. Description of the Related Art

A related art spark plug for use in an internal combustion engine includes a metal shell having a tool engaging portion and a threaded mounting portion, and an insulator inserted into a through hole which penetrates the metal shell in an axial direction. In such a related art spark plug, an airtight seal is provided between the insulator and the metal shell so as to prevent gas generated in the internal combustion engine from leaking through a gap between the insulator and the metal shell. In order to seal the space between the insulator and the metal shell, a technique is employed in which the upper end portion of the metal shell is crimped onto an outer circumference of the insulator and a portion of the metal shell is compressively deformed (see, e.g., Patent Document 1)

Patent Document 1: JP-A-2007-141868

3. Problems to be Solved by the Invention

Meanwhile, there has been a demand for a reduction in the size and diameter of spark plugs in order to enhance the degree of freedom in the design of internal combustion engines. However, since the mechanical strength of the insulator is decreased due to a reduction in size and diameter, it is difficult to provide an airtight seal between the insulator and the metal shell. In the above technique, for example, if a portion of the metal shell is too compressively deformed, the insulator may become damaged. If the compressive deformation on a portion of the metal shell is insufficient, the sealing properties between the insulator and the metal shell may be insufficient.

SUMMARY OF THE INVENTION

It is therefore an object of the invention to provide a method for manufacturing a spark plug which can provide an airtight seal between the insulator and the metal shell with high precision.

The above object has been achieved, in accordance with a first aspect of the invention, by providing a method for manufacturing a spark plug comprising the steps of: (a) preparing a metal shell including an insertion hole penetrating the metal shell in an axial direction, an intended crimping portion formed on an upper end of the insertion hole, a stepped portion of the metal shell which protrudes inwardly from an inner circumference of a lower end portion of the insertion hole and has a diameter smaller than that of the insertion hole, and an intended compressive deformation portion forming a portion of an inner peripheral wall of the insertion hole between the intended crimping portion and the stepped portion of the metal shell; (b) preparing an insulator including a first cylindrical portion of a substantially cylindrical shape, in which a metal terminal is exposed from an upper end thereof in an axial direction, a second cylindrical portion of a substantially cylindrical shape, in which a center electrode is exposed from a lower end thereof in an axial direction, and a stepped portion of the insulator formed between lower ends of the first cylindrical portion and an upper end of the second cylindrical portion; (c) inserting the insulator in the insertion hole of the metal shell; (d) forming the intended crimping portion of the metal shell into a crimping portion; and (e) pressing the lower side portion of the metal shell closer to a position lower than the intended compressive deformation portion, and pressing the crimping portion of the metal shell in an axial direction to compressively deform the intended compressive deformation portion of the metal shell and thereby seal a space between the stepped portion of the metal shell and the stepped portion of the insulator, wherein the step (e) controls a pressing amount of a press in a constant value from the start of compressive deformation to the end thereof.

In accordance with the above first aspect, since the pressing amount of the press is controlled at a constant value from the start of the compressive deformation to the end thereof, precision in the amount of compressive deformation of an intended portion can be improved. As a result, the sealing properties between the stepped portion of the metal shell and the insulator are secured with high precision, and it is possible to prevent damage to the insulator.

Further, according to a second aspect of the present invention, in addition to the first aspect of the present invention, the step (d) is performed using press molds different from the press molds used in the step (e).

Further, according to a third aspect of the present invention, in addition to the first aspect or the second aspect of the present invention, the step (e) is performed while the intended compressive deformation portion is being heated.

In the case where the compressive deformation is performed while the intended compressive deformation portion is being heated, it is difficult to control the compressive deformation amount. However, it is possible to improve precision in the compressive deformation amount in accordance with the invention. As a result, the sealing properties between the stepped portion of the metal shell and the insulator are secured with high precision, and it is possible to prevent damage to the insulator.

Further, according to a fourth aspect of the present invention, in addition to any one of the first to third aspects, the step (e) includes: (e1) measuring a relative position of the lower mold and the upper mold of the press in a state in which a first pressure is applied to the metal shell by the molds of the press before compressive deformation of the intended compressive deformation portion begins; (e2) moving the lower and upper molds relative to one another from the measured position to compressively deform the intended compressive deformation portion; (e3) measuring a relative position of the lower mold and the upper mold of the press in a state in which a second pressure is applied to the metal shell by the molds of the press after the step (e2); (e4) obtaining an actual compressive deformation amount of the intended compressive deformation portion from the position measured in the step (e1) and the position measured in the step (e3); and (e5) obtaining the pressing amount based on the actual compressive deformation amount obtained in step (e4).

In this manner, since the relative position between the lower mold and the upper mold is measured in a state in which the first pressure and the second pressure are applied, it is possible to improve measurement precision in the relative position between the lower mold and the upper mold. Consequently, the actual compressive deformation amount and the pressing amount can be measured with high precision.

According to a fifth aspect of the present invention, in addition to any one of the embodiments of the fourth aspect, the first pressure and the second pressure are in a range of 1% to 50% of the pressure required to compressively deform the intended compressive deformation portion.

In this manner, it is possible to improve measurement precision in the relative position between the lower mold and the upper mold.

According to a sixth aspect of the present invention, in addition to the fourth or fifth aspects, a subsequent pressing amount in the step (e2) is determined based on a difference between the actual compressive deformation amount obtained in the step (e4) and a predetermined compressive deformation amount.

In this manner, a prescribed value in step (e2) is determined using the difference between the actual compressive deformation amount obtained by the measurement and the predetermined value of the pressing amount, so that it is possible to improve precision in the compressive deformation amount.

According to a seventh aspect of the present invention, in addition to any one of the fourth to sixth aspects, the first pressure and the second pressure are equal to each other.

In this manner, since the relative position between the lower mold and the upper mold before the compressive deformation starts and the relative position between the lower mold and the upper mold after the compressive deformation begins are performed while the same pressure is applied, the pressing amount can be measured with high precision. As a result, it is possible to improve precision in the compressive deformation amount.

According to an eighth aspect of the present invention, in addition to any one of the first to seventh aspects, the metal shell includes a threaded mounting portion to be mounted on an internal combustion engine, and the threaded mounting portion has a diameter of 12 mm or less. In this manner, it is possible to improve precision in the compressive deformation amount in a spark plug including a threaded mounting portion having a diameter of 12 mm or less.

According to a ninth aspect of the present invention, in addition to any one of the first to eighth aspects, the metal shell includes a tool engaging portion having a hexagonal columnar shape for engaging a tool when the metal shell is being mounted on an internal combustion engine, and an opposite side distance of the tool engaging portion is 14 mm or less in length.

In this manner, it is possible to improve precision in the compressive deformation amount in a spark plug including a tool engaging portion having an opposite side distance of 14 mm or less in length.

The invention can be implemented in various ways. For example, the invention can be implemented as an apparatus for manufacturing a spark plug, a press machine for manufacturing a spark plug, or the like.

BRIEF DESCRIPTION OF THE DRAWINGS

Illustrative aspects of the invention will be described in detail with reference to the drawings in which.

DETAILED DESCRIPTION OF THE PREFERRED EMBODIMENTS

The invention will now be described with reference to the drawings. However, the present invention should not be construed as being limited thereto.

A. Example 1

Configuration of Spark Plug

Figure 1:
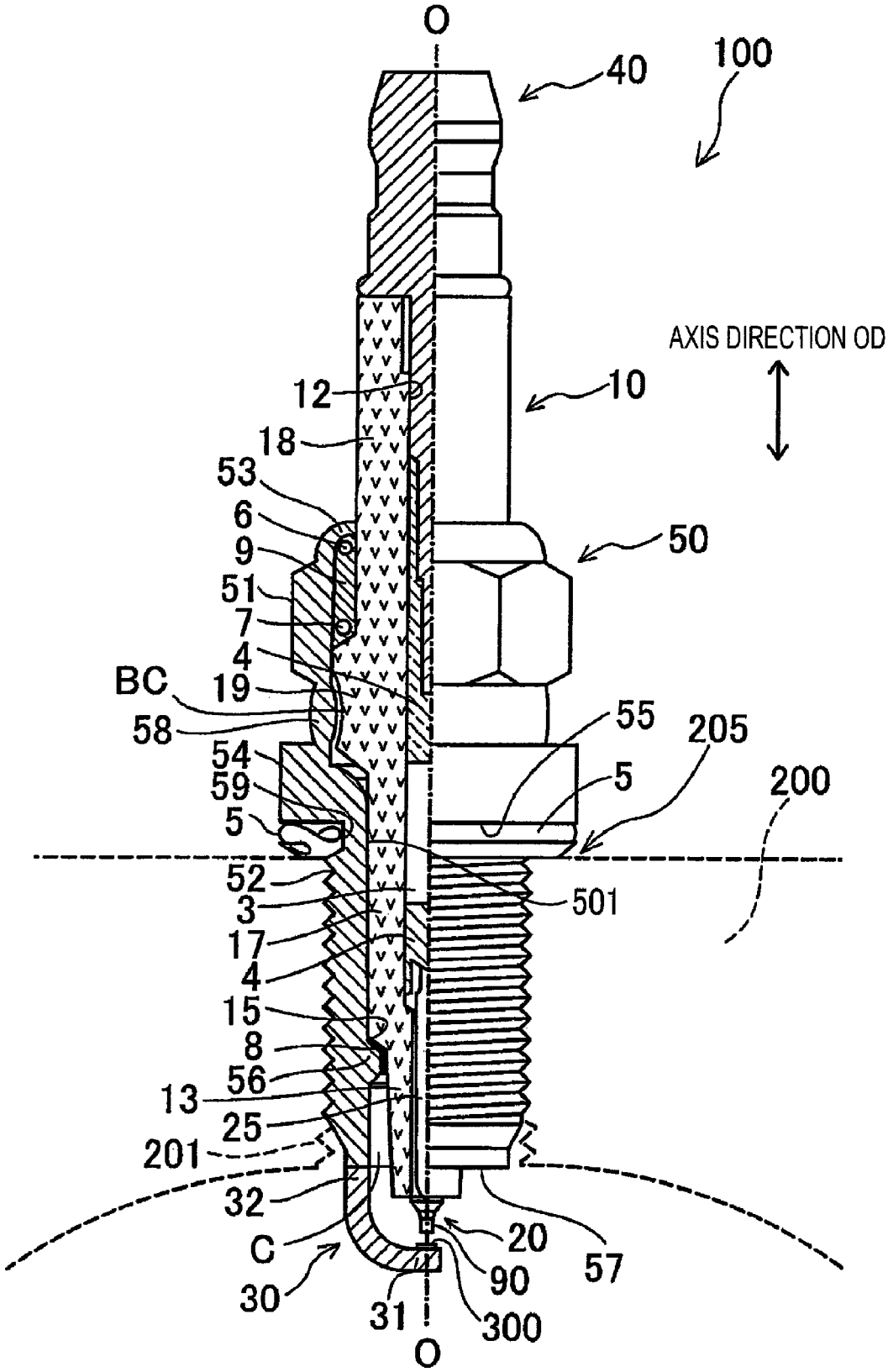
FIG. 1 is a partial cross-sectional view of a spark plug to be manufactured according to an exemplary embodiment.

FIG. 1 is a partial cross-sectional view of a spark plug 100 manufactured in accordance with the invention. In this instance, in FIG. 1, the axial direction OD of the spark plug 100 is defined as the vertical direction, in which the lower side is referred to as the leading end side of the spark plug 100, and the upper side is referred to as the rear end side. In FIG. 1, the right side of the axis O-O indicated by a dash-dotted line shows a front view of the external appearance, and the left side of the axis O-O shows a cross-sectional view of the spark plug 100 which is cut along a cross-section passing through the central axis of the spark plug 100.

As shown in FIG. 1, the spark plug 100 includes an insulator 10 serving as an insulating material, a metal shell 50, a center electrode 20, a ground electrode 30, and a metal terminal 40. The metal shell 50 is provided with an insertion hole 501 penetrating the metal shell in the axial direction OD. The insulator 10 is inserted and held in the insertion hole 501 of the metal shell 50. The center electrode 20 is held in the insulator 10 in the axial direction OD. A distal end portion of the center electrode 20 is exposed towards the distal end portion of the insulator 10. The ground electrode 30 is joined to a leading end portion (an end portion of the lower side in FIG. 1) of the metal shell 50. The metal terminal 40 is installed on the rear end portion (an end portion of the upper side in FIG. 1) of the insulator 10, and the rear end portion of the metal terminal 40 is exposed towards the rear end side of the insulator 10.

The insulator 10 is formed by sintering alumina or the like, as is known in the art, and is formed in a cylindrical shape with an axial hole 12 which is formed in the center of an axis and extends in the axial direction OD. The insulator is provided with a flange portion 19 having a largest outer diameter at a substantially center portion of the axial direction OD, and a rear-end barrel portion 18 formed at a position closer to a rear end side (an upper side in FIG. 1) than the flange portion. A leading end barrel portion 17 having an outer diameter smaller than that of the rear-end side barrel portion 18 is formed at a position closer to a leading end side (a lower side in FIG. 1) than the flange portion 19, and a leg length portion 13 having an outer diameter smaller than that of the leading end barrel portion 17 is formed at a portion closer to the rear end side than the leading end barrel portion 17. The leg length portion 13 has a diameter which decreases towards a leading end side thereof, and the decreased diameter portion is exposed at a combustion chamber when the spark plug 100 is attached to an engine head 200 of an internal combustion engine. A stepped portion 15 of the insulator 10 is formed between the leg length portion 13 and the leading end barrel portion 17. In accordance with the above description, the leg length portion 13 in this example corresponds to a second cylindrical portion of the invention, and the leading end barrel portion 17, the rear-end barrel portion 18 and the flange portion 19 at a position closer to the rear end side (the upper side in FIG. 1) than the leg length portion 13 correspond to a first cylindrical portion of the invention.

The metal shell 50 is a cylindrical shell which fixes the spark plug 100 to the engine head 200 of the internal combustion engine. The metal shell 50 holds the insulator 10 in such a way that the metal shell encloses a portion extending from a portion of the rear-end barrel portion 18 to the leg strength portion 13. That is, it is configured such that the insulator 10 is inserted into the insertion hole 501 of the metal shell 50, and the leading end and the rear end of the insulator 10 are exposed from the leading end and the rear end of the metal shell 50, respectively. The metal shell 50 is made of low carbon steel, and is provided with a tool engaging portion 51 with a hexagonal columnar shape adapted to engage a spark plug wrench which is not shown. In this example, parallel sides of the tool engaging portion 51 of the hexagonal columnar shape, that is, the opposite sides, is 14 mm in length, or possibly shorter at 9 to 13 mm. The metals shell 50 includes a threaded mounting portion 52 having a threaded portion to be screwed into a mounting hole 201 of the engine head 200 which is installed to the upper portion of the internal combustion engine. In this example, the threaded mounting portion 52 has an outer diameter M (a nominal diameter) of M12 (12 mm) or M8 to M11 smaller than M12.

A flange-shaped seal portion 54 is formed between the tool engaging portion 51 and the threaded mounting portion 52 of the metal shell 50. An annular gasket 5 formed by bending a plate body is inserted in a screw head 59 between the threaded mounting portion 52 and the seal portion 54. When the spark plug 100 is attached to the engine head 200, the gasket 5 is pressed and deformed between the seat surface 55 of the seal portion 54 and an opening peripheral edge portion 205 of a threaded mounting hole 201. Deformation of the gasket 5 seals the space between the spark plug 100 and the engine head 200 to prevent gas leakage from the inside of the engine through the threaded mounting hole 201.

The metal shell 50 is provided with a thin crimping portion 53 at a position closer to the rear side than the tool engaging portion 51. Also, a thin compressively-deformed portion 58 is provided between the seal portion 54 and the tool engaging portion 51, as well as the crimping portion 53. Annular ring members 6 and 7 are interposed between an inner circumferential surface of the metal shell 50 and an outer circumferential surface of a rear end side barrel portion 18 of the insulator 10 from the tool engaging portion 51 to the crimping portion 53, and a space between the ring members 6 and 7 is filled with talc powder 9. The crimping portion 53 is inwardly bent to fix the crimping portion 53 onto the outer circumferential surface of the insulator 10.

In the metal shell 50, the thin compressively-deformed portion 58 is provided between the seal portion 54 and the tool engaging portion 51. At manufacture, the crimping portion 53 fixed on the outer circumferential surface of the insulator 10 is pressed towards the leading end side, so that the portion to become the compressive deformation portion 58 is compressively deformed. The insulator 10 is pressed towards the leading end side in the metal shell 50 through the ring members 6 and 7 and the talc 9 by the compressive deformation of the compressive deformation portion 58. By this pressing, a stepped portion 15 (a stepped portion of the insulator) of the insulator 10 is pressed on a stepped portion 56 (a stepped portion of the metal shell) formed at a position of the threaded mounting portion 52 at the inner circumferential surface of the metal shell 50 via an annular plate packing 8, and the metal shell 50 and the insulator 10 are combined together. Airtightness between the metal shell 50 and the insulator 10 is maintained by the plate packing 8, to thereby prevent leakage of combustion gas. Further, by this pressing, the talc 9 is compressed in the axis direction OD to increase the airtightness in the metal shell 50. In this instance, a clearance C of a predetermined dimension is provided between the metal shell 50 and the leg length portion 13 of the insulator 10 at a portion closer to the leading end side than the stepped portion 56 of the metal shell.

The center electrode 20 is a rod-shaped electrode having a configuration in which a core material 25 is embedded in an electrode base material 21. The base material 21 is made of nickel alloy, such as INCONEL 600 (trademark) or the like, or an alloy containing nickel as a main component thereof, and the core material 25 is made of copper or an alloy containing copper as a main component thereof which has a thermal conductance higher than that of the electrode base material 21. Generally, the center electrode 20 is manufactured by filling the core material 25 inside the electrode base material 21 formed in a blind cylindrical shape, and extrusion molding the filled electrode base material at a bottom side and stretching. The core material 25 has a substantially constant outer diameter at the barrel portion, of which the distal end side is tapered to have a sharp tip. The distal end portion of the center electrode 20 is formed in a tapered shape having a diameter which decreases towards a distal end thereof. The tapered distal end is bonded with an electrode tip 90. For example, the center electrode 20 and the electrode tip 90 are bonded to each other by laser welding. The electrode tip 90 is made of an alloy containing a noble metal as a main component thereof which has a high melting point so as to enhance spark wear resistance. For example, the electrode tip 90 can be made of iridium (Ir) or an Ir alloy containing iridium as a main component and one or two or more selected from platinum (Pt), rhodium (Rh), ruthenium (Ru), palladium (Pd) and rhenium (Re). In particular, an Ir-5 Pt alloy (an iridium alloy containing platinum of 5 wt %) or the like can be used.

The center electrode 20 extends towards the rear end side in the axial hole 12, and is electrically connected to the metal terminal 40 at the rear side via a seal body 4 and a ceramic resistor 3. The metal terminal 40 is connected to a high-voltage cable (not shown) via a plug cap (not shown) so as to apply a high voltage thereto.

An electrode base material of the ground electrode 30 is made of a metal having a high corrosion resistance, for example, a nickel alloy. In this example, a nickel alloy referred to as INCONEL (trademark) 600 (INC600) is used. The base end portion (one end portion) 32 of the base material of the ground electrode 30 is welded to a leading end surface of the metal shell 50. The base material of the ground electrode 30 is bent in a direction opposite the axis direction OD such that a lateral surface of a distal end portion (the other end portion) 31 thereof faces the electrode tip 90 of the center electrode 20 along the axis O. A spark gap is formed between one lateral surface of the distal end portion 31 of the base material of the ground electrode 30 and the distal end surface of the electrode tip 90. The spark gap is, for example, about 0.4 to 1.5 mm.

An electrode tip 300 is resistance-welded to the distal end portion 31 of the base material of the ground electrode 30 at a lateral surface opposite the electrode tip 90. The electrode tip 300 is made of platinum (Pt) or an alloy containing Pt as a main component thereof. In this example, a Pt-20 Ir alloy (a platinum alloy containing iridium of 20 wt %) or the like is used.

Method of Manufacturing Spark Plug

Figure 2:
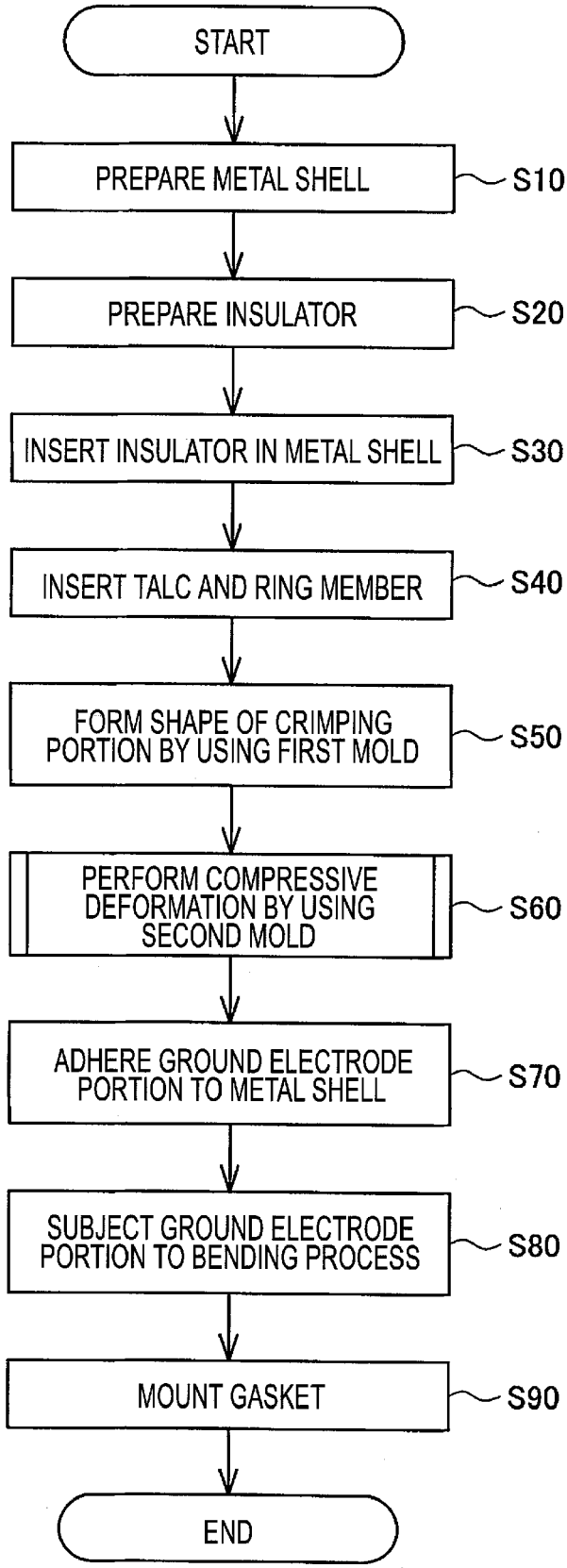
FIG. 2 is a flowchart illustrating a process of a manufacturing method of a spark plug.
Figure 3:
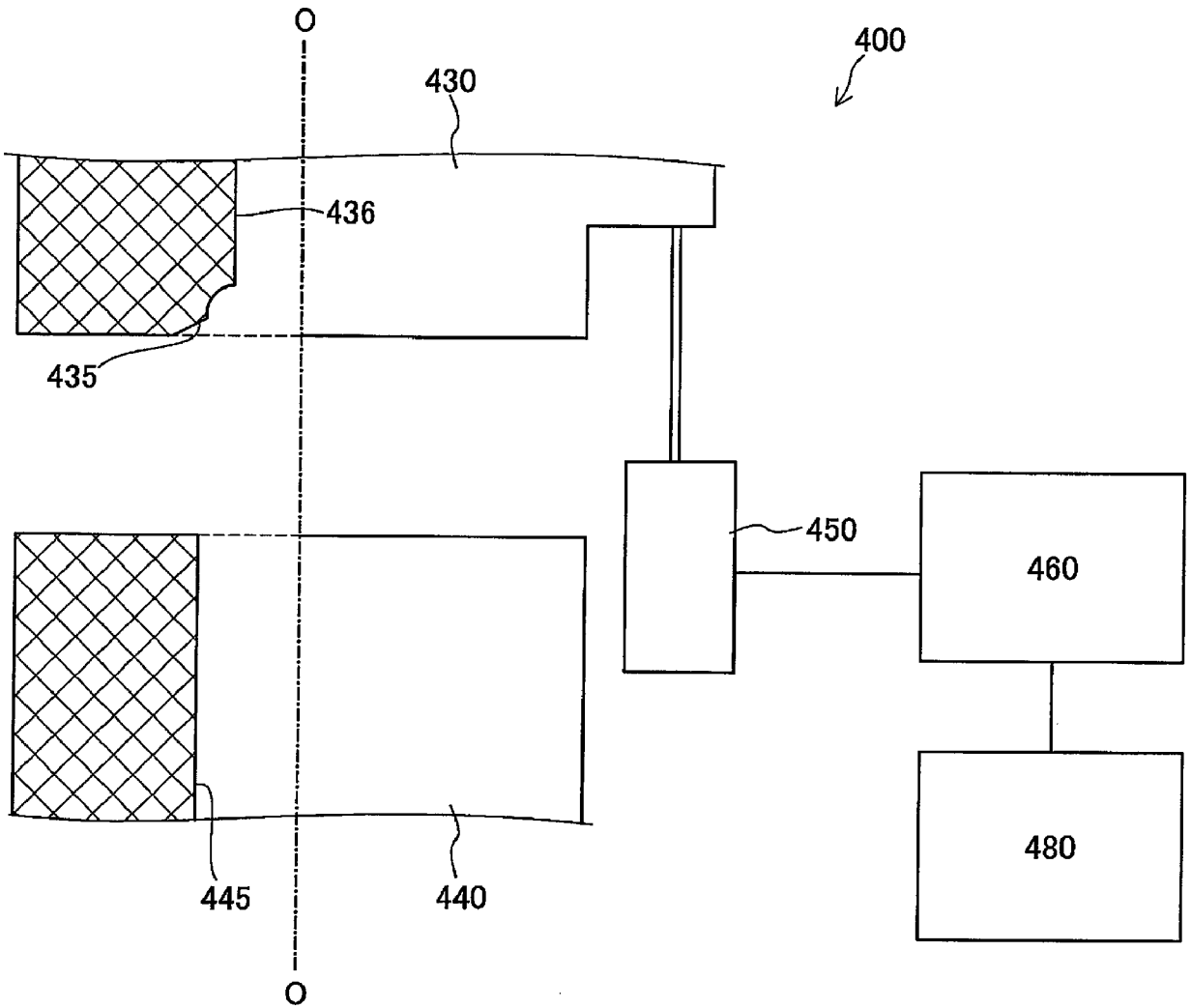
FIG. 3 is a perspective view of a press machine used in a crimping portion forming process and a compressive deformation portion forming process.

FIG. 2 is a flowchart illustrating a process of a method for manufacturing the spark plug 100. FIG. 3 is a view schematically illustrating a press machine used in a process (crimping portion forming process) of forming the crimping portion 53 of the metal shell 50 and a process (a compressive deformation portion forming process) of forming the compressive deformation portion 58 of the metal shell 50. FIG. 4 is a view illustrating an aspect of the crimping portion forming process. The method of manufacturing the spark plug 100 will now be described based on a process of fixing the insulator 10 and the metal shell 50, the crimping portion forming process, and the compressive deformation portion forming process. In FIGS. 3 and 4, the right side of the axis O-O indicated by a dash-dotted line shows a front view of the external appearance, and the left side of the axis O-O shows a cross-sectional view of the spark plug 100 or press mold which is cut along a cross-section passing the central axis of the spark plug 100 or press mold.

In step S10, the metal shell 50 is prepared. As shown in FIG. 4, the metal shell 50 prepared in this step is provided with an intended crimping portion 53*a* which is formed as the crimping portion 53 shown in FIG. 1 in the crimping portion forming process described below, and an intended compressive deformation portion 58*a* which is formed as the compressive deformation portion 58 shown in FIG. 1 in the compressive deformation portion forming process described below. In step S20, the insulator 10 is prepared. In this step, the insulator 10 is prepared in which the metal terminal 40 and the seal body 4, the ceramic resistor 3, and the center electrode 20 are placed. In step S30, the insulator 10 is inserted into the insertion hole 501 of the metal shell 50 from the upward side together with the plate packing 8. In step S40, in the state in which the insulator 10 is inserted in the metal shell 50, the talc 9 and the ring members 6 and 7 are inserted between the insertion hole 501 of the metal shell 50 and the rear end side barrel portion 18 of the insulator 10. FIG. 4 shows the insulator 10 and the metal shell 50 after S40 has been completed.

In step S50, the crimping portion forming process of forming the intended crimping portion 53*a* into the crimping portion 53 is carried out using a first mold. FIG. 3 shows a press machine 400 used in step S50 and step S60 described below. The press machine 400 can be attached with an upper mold and a lower mold, and FIG. 3 shows an upper mold 430 and a lower mold 440 which are second molds used in the compressive deformation portion forming process of step S60. The press machine 400 includes a linear gauge 450 which can measure a position of the upper mold. A measured result of the linear gauge 450 is transmitted to a control unit 460. The control unit 460 controls a power unit 480 automatically or manually to operate the upper mold in the direction of the axis O-O. The power unit 480 is a power mechanism that moves the upper mold in the direction of the axis O-O. For example, a known press power mechanism including an electric motor and a hydraulic mechanism may be used as the power mechanism.

Figure 4B:
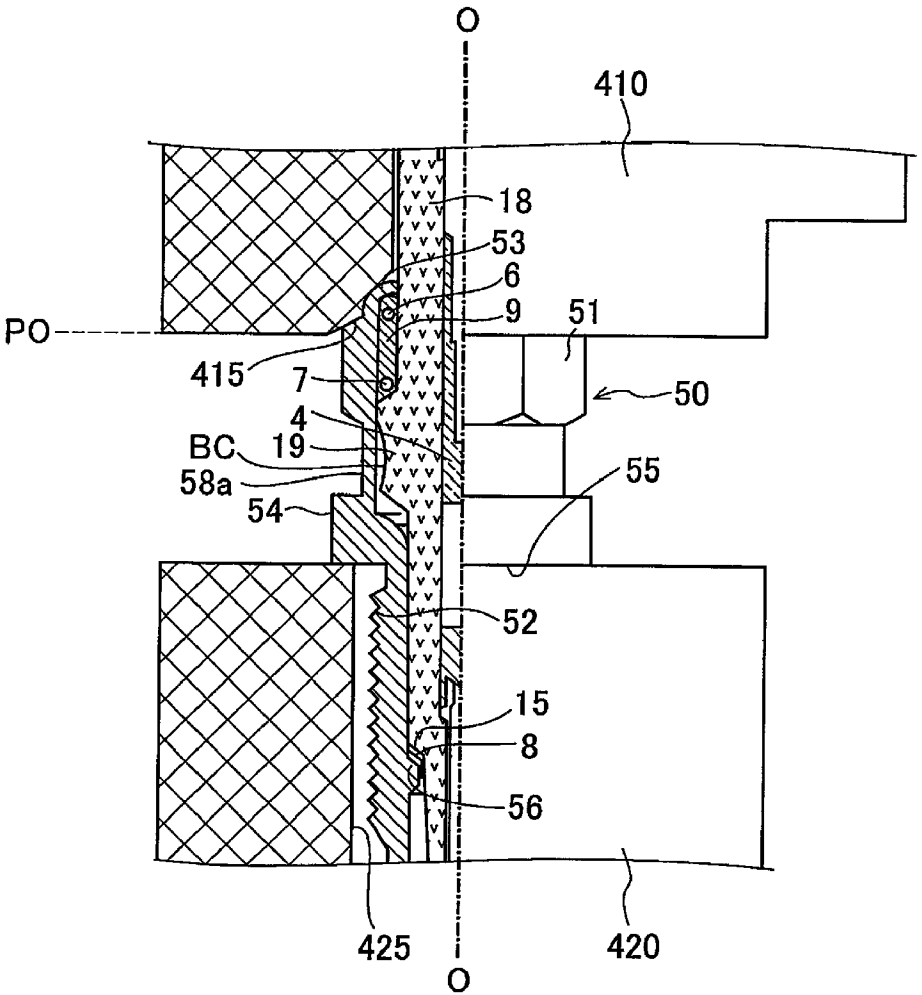
FIG. 4A and FIG. 4B are views illustrating an aspect of a crimping portion forming process.
Figure 4A:
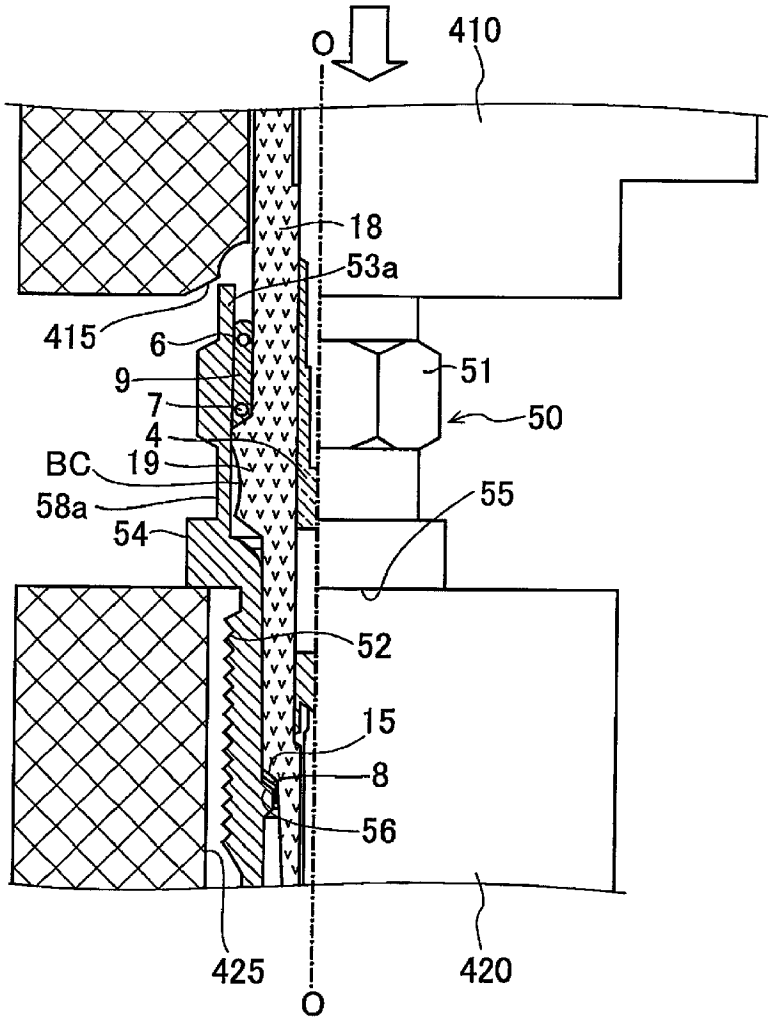

As shown in FIG. 4, the lower mold 420, which is the first mold used in the crimping portion forming process, is provided with a set hole 425 to set the metal shell 50 in which the insulator 10 is inserted. The diameter of the set hole 425 is larger than that of the threaded mounting portion 52 of the metal shell 50, and is smaller than that of the seal portion 54. Consequently, a seat surface 55 of the seal portion 54 of the metal shell 50 is supported on a peripheral edge portion of the upper end of the set hole 425 of the lower mold 420. As shown in FIG. 4A, the upper mold 410 which is the first mold is provided with a forming portion 415 having a shape corresponding to the surface shape of the upper side of the crimping portion 53 (FIG. 1). The upper mold 410 and the lower mold 420 of the first mold are made of cast iron having a relatively high hardness.

If the upper mold 410 is lowered to a predetermined position PO at a lower side in the direction of the axis O-O from the state shown in FIG. 4A, the forming portion 415 of the upper mold 410 plastically deforms the intended crimping portion 53*a* to form the crimping portion 53 (FIG. 4B). As a result, an end portion of the crimping portion 53 is pressed towards an outer circumferential surface of the insulator 10.

Figure 5:
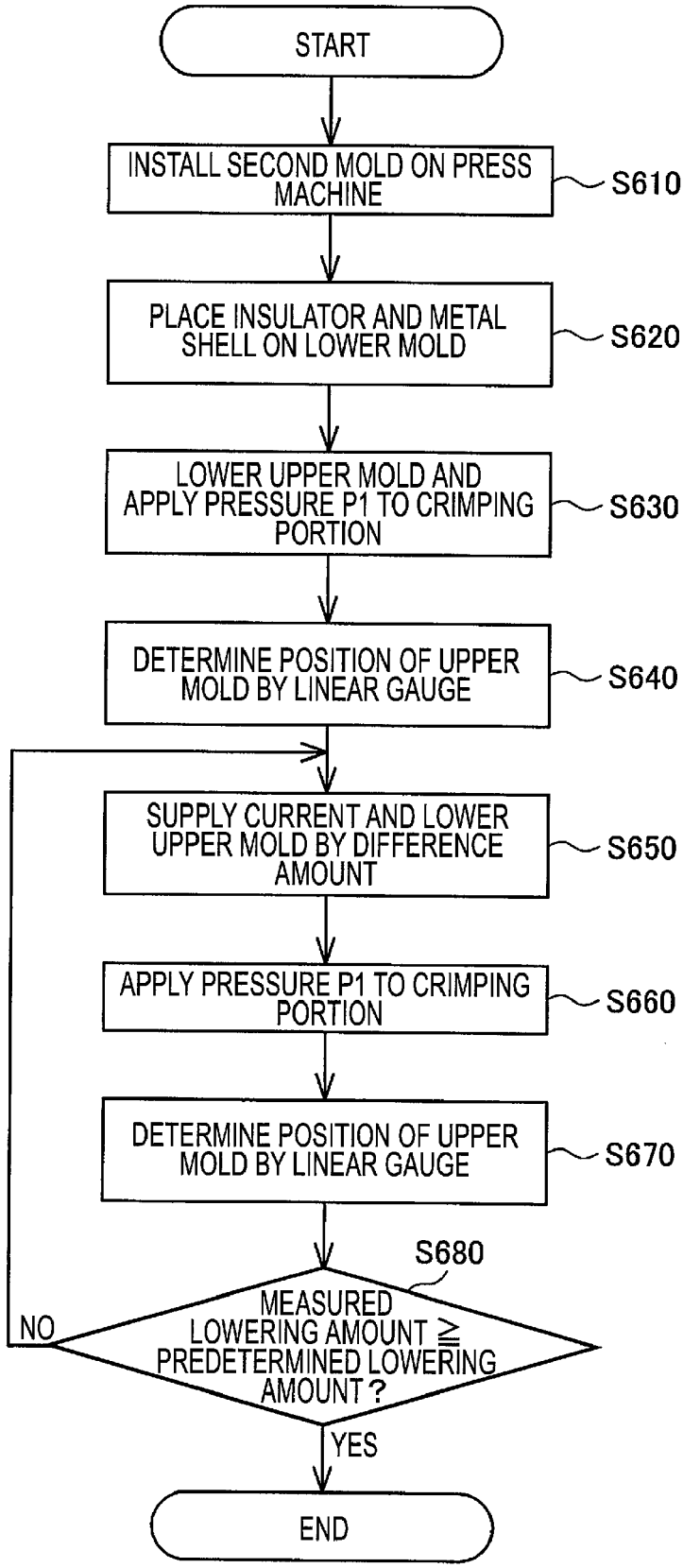
FIG. 5 is a flowchart illustrating steps of a compressive deformation portion forming process.
Figures 6A, 6B:
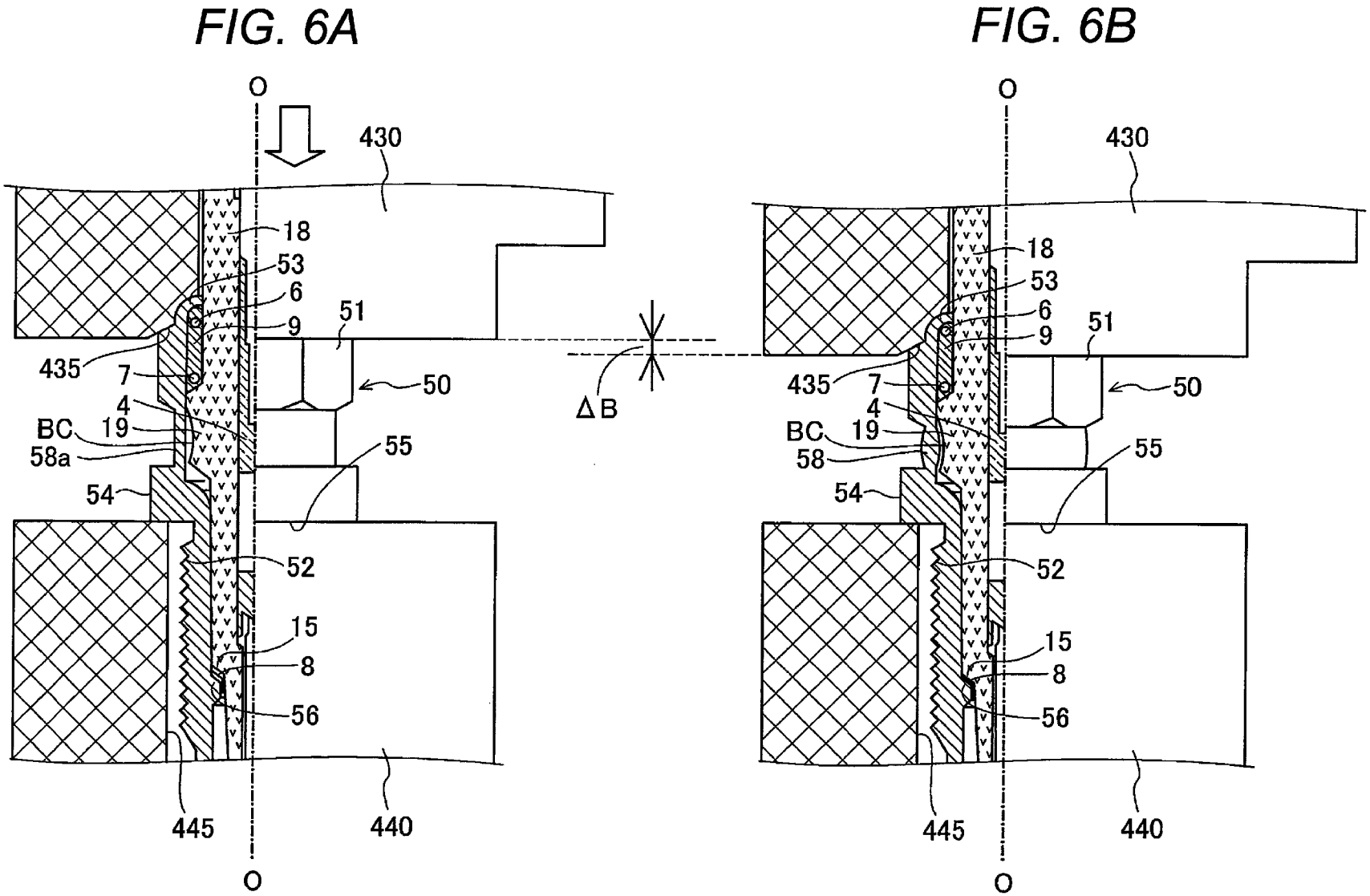
FIG. 6A and FIG. 6B are views illustrating an aspect of a compressive deformation portion forming process.

In step S60, the compressive deformation portion forming process of forming the compressive deformation portion 58 by compressively deforming the intended compressive deformation portion 58*a* with a second mold which is different from the first mold is carried out. FIG. 5 is a flowchart illustrating the steps of the compressive deformation portion forming process. FIG. 6 is a view illustrating an aspect of the compressive deformation portion forming process.

In step S610, the upper mold 430 and the lower mold 440 constituting the second mold are installed on the press machine 400. The second mold has the same shape as the first mold. That is, the upper mold 430 is provided with a forming portion 435 having a shape corresponding to the surface shape of the upper side of the crimping portion 53 (FIG. 1), and a press machine insertion hole 436 for inserting not the rear end side barrel portion 18 but the rear end side of the insulator 10, as shown in FIG. 3. The lower mold 440 is provided with a set hole 445 in which the metal shell 50 is placed. The difference between the second mold and the first mold is that the first mold is made of cast iron, while the second mold is made of copper having a thermal conductivity higher than that of cast iron or an alloy containing copper as a main component thereof. The reason the second mold is made of a material having a high thermal conductivity is that the intended compressive deformation portion 58*a* is preheated by supplying an electric current to the metal shell 50 via the second mold, as described below. Since copper or the alloy containing copper as a main component thereof has a lower wear resistance compared with cast iron, the formation of the crimping portion 53 is performed using the first mold made of cast iron.

In step S620, the metal shell 50 formed with the crimping portion 53 and the insulator 10 are placed in the set hole 445 of the lower mold 440. In step S630, the upper mold 430 is lowered to contact the forming portion 435 and the crimping portion 53 and thus apply pressure P1 to the crimping portion 53. The pressure P1 is a predetermined pressure which is in the range of 1% to 50% of the pressure Pmax required to compressively deform the intended compressive deformation portion 58*a* to obtain the compressive deformation portion 58. In this example, the pressure P1 is set to be 5% of the pressure Pmax. In the state in which the pressure P1 is applied, the intended compressive deformation portion 58*a* does not begin to compressively deform.

In step S640, in the state in which the pressure P1 is applied to the crimping portion 53, the position of the upper mold 430 is measured using the linear gauge 450. In step S650, the intended compressive deformation portion 58*a* is heated by supplying electric current to the metal shell 50 via the upper mold 430 and the lower mold 440, and the upper mold 430 is lowered by a predetermined compressive deformation amount ΔB. As a result, the cross-section of the intended compressive deformation portion 58*a* is compressively deformed to assume a barrel shape, so as to form the compressive deformation portion 58. Since the flange portion 19 of the insulator 10 opposite the compressive deformation portion 58 is provided with a clearance shape BC, it does not interfere with the compressive deformation portion 58.

In step S660, the pressure P1 is applied to the crimping portion 53 via the upper mold 430, similar to step S630. In step S670, in the state in which the pressure P1 is applied to the crimping portion 53, the position of the upper mold 430 is measured using the linear gauge 450. The reason why the position of the upper mold 430 is measured while the pressure P1 is applied is that spring-back of the crimping portion 53 and the compressive deformation portion 58 is suppressed to accurately measure the compressively deformed amount of the compressive deformation portion 58.

In step S680, a determination is made as to whether the predetermined lowering amount of the target value (a predetermined compressive deformation amount) is equal to the actual lowering amount (the measured lowering amount=the actual compressive deformation amount) of the upper mold which is obtained from a difference between the position of the upper mold measured at step S640 and the position of the upper mold measured at step S670. As used herein, the phrase "the measured lowering amount is equal to the predetermined lowering amount" means that the difference between the measured lowering amount and the predetermined lowering amount is within a predetermined error range.

In the case in which the measured lowering amount is equal to or more than the predetermined lowering amount (Yes in step S680), the compressive deformation portion forming process is completed. For example, a spark plug for which the measured lowering amount is equal to the predetermined lowering amount is a non-defective product, and is used in the following manufacturing process. A spark plug for which the measured lowering amount is more than the predetermined lowering amount is a defective product, and is not used in the following manufacturing process. If spark plugs for which the measured lowering amount is more than the predetermined lowering amount are continuously formed over a predetermined number of times, then the lowering amount of the press in step S650 is apparently set too high. In that case, the lowering amount of the press in step S650 is changed to be lower than the predetermined amount in the next compressive deformation portion forming process. The reason why the measured lowering amount (the actual compressive deformation amount) and the predetermined lowering amount (the predetermined compressive deformation amount) may not be equal to each other for a given lowering step may be due to the degree of precision in control of the press machine, the influence of heat for thermal crimping, error caused by vibration of the press machine, or the like. In general, there are many cases in which the lowering amount of the press machine required for the control is larger than the predetermined compressive deformation amount.

In the case where the measured lowering amount is lower than the predetermined lowering amount, the process returns to step S650, and the upper mold 430 is lowered by the difference between the measured lowering amount and the predetermined lowering amount. The processes S650 to S670 are repeated until the measured lowering amount is equal to the predetermined lowering amount.

In carrying out the compressive deformation portion forming process, talc 9 is appropriately compressed, and the stepped portion 15 of the insulator 10 (the stepped portion of the insulator) is pressed at an appropriate pressure against the stepped portion 56 of the metal shell 50 (the stepped portion of the metal shell) via the plate packing 8. As a result, since the sealing properties between the stepped portion 15 of the insulator and the stepped portion 56 of the metal shell are secured, it is possible to prevent leakage of gas from the internal combustion engine in use of the spark plug 100.

If the compressive deformation portion forming process is completed, the ground electrode 30 welded to the electrode tip 300 is adhered to the leading end portion of the metal shell 50 (step S70), and the ground electrode 30 is bent in such a way that the electrode tip 300 of the ground electrode 30 is opposite the electrode tip 90 of the center electrode 20 (step S80). The gasket 5 is mounted on the threaded mounting portion 52 of the metal shell 50 to complete the spark plug 100 (step S90).

According to the example described above, since the compressive deformation amount of the compressive deformation portion 58 is controlled by controlling the lowering amount of the upper mold 430 of the press machine at a predetermined value ΔB, the precision of the compressive deformation amount of the compressive deformation portion 58 can be improved. Conventionally, the crimping portion 53 is applied with a predetermined added weight by the upper mold 430, and the compressive deformation portion 58 is formed by the added weight. In this instance, the compressive deformation of the compressive deformation portion 58 progresses, and when a repulsive force of the compressive deformation portion 58 is higher than the determined added weight applied to the crimping portion 53, the compressive deformation portion forming process is completed. For this reason, problems arise where a difference between the compressive deformation amount of the compressive deformation portion 58 is increased in accordance with precision of the intended compressive deformation portion 58*a* part of the metal shell 50. For example, in a case where the compressive deformation amount of the compressive deformation portion 58 is smaller than the predetermined compressive deformation amount, the sealing property between the stepped portion 15 on the insulator and the stepped portion 56 on the metal shell is insufficient. On the other hand, in a case where the compressive deformation amount of the compressive deformation portion 58 is higher than the predetermined compressive deformation amount, the insulator 10 may be ruptured at a portion of the stepped portion 15 on the insulator. Such problems are more apparent in a spark plug having a small diameter, more specifically, in a spark plug including the threaded mounting portion 52 having an outer diameter of 12 mm or less or a tool engaging portion 51 having an opposite side of 14 mm or less in length. Further, such a problem is apparent in the case of heat crimping where the intended compressive deformation portion 58*a* is compressively deformed while the intended compressive deformation portion 58*a* is heated by an electric current or the like. In heat crimping, the heating condition of the intended compressive deformation portion 58*a* is varied by the component precision of the metal shell 50 or the like, such as the thickness of the intended compressive deformation portion 58*a*. As a result, in heat crimping, a variation in the compressive deformation amount easily occurs, as compared with cold crimping where the intended compressive deformation portion 58*a* is compressively deformed without heating the intended compressive deformation portion 58*a*.

According to the compressive deformation portion forming process of this example, precision in the compressive deformation amount is improved by controlling the lowering amount of the upper mold 430 of the press machine at a predetermined value ΔB. In particular, it is possible to suppress seal defects from occurring between the stepped portion 15 of the insulator and the stepped portion 56 of the metal shell and to suppress defects caused by damage to the insulator 10, in spark plugs having a small diameter.

Further, since the position of the upper mold 430 is measured to obtain the measured lowering amount while the predetermined pressure P1 is applied, it is possible to suppress influence of the spring-back of the crimping portion 53 or the compressive deformation portion 58, to thereby obtain the measured lowering amount with high precision.

In addition, in a case where there is a difference between the measured lowering amount and the predetermined lowering amount, the difference is fed back to control the lowering amount of the upper mold 430 of the press. In this manner, precision in the compressive deformation amount of the compressive deformation portion 58 is further improved to suppress the occurrence of defective products. The next pressing amount may be determined for each such previous difference, or may be determined from an average value of the differences of several previous operations.

B. Modified Example

First Modified Example

Although the invention is applied to the compressive deformation portion forming process by heat crimping in the above example, the invention may also be applied to cold crimping. In this instance, since current does not flow in the mold, both the crimping portion forming process and the compressive deformation portion forming process may be performed using a first mold made of cast iron.

Second Modified Example

Although the lower mold 440 is stationary and the upper mold 430 is moved downward in the above example, the upper mold 430 is stationary and the lower mold 440 may be moved upward. In general, the upper mold may be moved down to approach a relative position between the lower mold and the upper mold of the press, and the pressing amount, which is an amount approaching the relative position between the lower mold and the upper mold of the press, may be controlled to a constantly prescribed value. Since the lower mold 440 is stationary and the upper mold 430 is moved downward in this example, the position of the upper mold 430 is measured by the linear gauge 450. However, the relative position between the lower mold and the upper mold of the press may be measured.

Third Modified Example

According to the above example, in the position measurement of the upper mold 430 by the linear gauge 450, the position is measured while the same pressure P1 is applied to the crimping portion 53 at the time of measuring the position before the start of the compressive deformation or after completing the compressive deformation. The invention is not limited thereto, and a relatively appropriate measurement precision can be obtained even while a different pressure is applied at the time of measuring the position before the start of the compressive deformation and after completing the compressive deformation. In this instance, preferably, the applied pressure at the time of measuring the position before the start of the compressive deformation and the applied pressure at the time of measuring the position after completing the compressive deformation are relatively close. Also, preferably, the applied pressure at the time of measuring the position before the start of the compressive deformation and the applied pressure at the time of measuring the position after completing the compressive deformation are within a range of 5% to 50% of the pressure Pmax required to compressively deform the compressive deformation portion 58.

Fourth Modified Example

Although the upper mold 430 is initially lowered by the predetermined compressive deformation amount ΔB in step S650 of the above example, the upper mold 430 may be initially lowered by an amount ΔC (e.g., 90% of the predetermined compressive deformation amount ΔB) smaller than the predetermined compressive deformation amount ΔB, and then the upper mold 430 may be lowered by the difference between the predetermined compressive deformation amount ΔB and the measured lower amount. In this manner, it is possible to suppress problems where the measured lowering amount is more than the predetermined amount of compressive deformation ΔB.

Fifth Modified Example

As described in the above example, although the invention is preferably applied to the manufacture of the spark plug having a small diameter, the invention may be applied to the manufacture of a spark plug having a reference diameter or large diameter. For example, the invention may be applied to the manufacture of a spark plug including the threaded mounting portion 52 having a diameter of 13 mm to 18 mm and the tool engaging portion 51 having an opposite side of 15 mm to 20 mm in length.

Sixth Modified Example

Although the above example is described by way of an example of a longitudinal discharge type spark plug 100 where the electrode tip 90 of the center electrode 20 and the electrode tip 300 of the ground electrode 30 oppose one another in the axis direction OD, the invention is not limited thereto. For example, the invention may be applied to a transverse discharge type spark plug where the electrode tip 90 of the center electrode 20 and the electrode tip 300 of the ground electrode 30 oppose one another in a direction perpendicular to the axis direction OD. A positional relationship between the distal end portion of the ground electrode and the distal end portion of the center electrode 20 may be appropriately set in accordance with the intended application of the spark plug, its desired performance or the like. Further, a plurality of ground electrodes may be installed with respect to one center electrode.

It should further be apparent to those skilled in the art that various changes in form and detail of the invention as shown and described above may be made. It is intended that such changes be included within the spirit and scope of the claims appended hereto.

The present application claims priority from Japanese Patent Application No. 2009-028462, which was filed on Feb. 10, 2009, the disclosure of which is herein incorporated by reference in their entirety.

What is claimed is:

1. A method for manufacturing a spark plug comprising the steps of:

(a) preparing a metal shell including an insertion hole penetrating the metal shell in an axial direction, an intended crimping portion formed on an upper end of the insertion hole, a stepped portion of the metal shell which protrudes inwardly from an inner circumference of a lower end portion of the insertion hole and has a diameter smaller than that of the insertion hole, and an intended compressive deformation portion forming a portion of an inner peripheral wall of the insertion hole between the intended crimping portion and the stepped portion of the metal shell;

(b) preparing an insulator including a first cylindrical portion of a substantially cylindrical shape, in which a metal terminal is exposed from an upper end thereof in an axial direction, a second cylindrical portion of a substantially cylindrical shape, in which a center electrode is exposed from a lower end thereof in an axial direction, and a stepped portion of the insulator formed between lower ends of the first cylindrical portion and an upper end of the second cylindrical portion;

(c) inserting the insulator in the insertion hole of the metal shell;

(d) forming the intended crimping portion of the metal shell into a crimping portion; and (e) pressing the lower side portion of the metal shell closer to a position lower than the intended compressive deformation portion, and pressing the crimping portion of the metal shell in an axial direction to compressively deform the intended compressive deformation portion of the metal shell and thereby seal a space between the stepped portion of the metal shell and the stepped portion of the insulator, wherein the step (e) controls a pressing amount of a press in a constant value from the start of compressive deformation to the end thereof.

2. The method for manufacturing a spark plug according to claim 1, wherein step (d) is performed using press molds different from the press molds used in step (e).

3. The method for manufacturing a spark plug according to claim 1, wherein step (e) is performed while the intended compressive deformation portion is being heated.

4. The method for manufacturing a spark plug according to claim 1, wherein step (e) includes:

(e1) measuring a relative position of the lower mold and the upper mold of the press in a state in which a first pressure is applied to the metal shell by the molds of the press before compressive deformation of the intended compressive deformation portion begins;

(e2) moving the lower and upper molds relative to one another from the measured position to compressively deform the intended compressive deformation portion;

(e3) measuring a relative position of the lower mold and the upper mold of the press in a state in which second pressure is applied to the metal shell by the molds of the press after the step (e2);

(e4) obtaining an actual compressive deformation amount of the intended compressive deformation portion from the position measured in the step (e1) and the position measured in the step (e3); and (e5) obtaining the pressing amount based on the actual compressive deformation amount obtained in step (e4).

5. The method for manufacturing a spark plug according to claim 4, wherein the first pressure and the second pressure are in a range of 1% to 50% of the pressure required to compressively deform the intended compressive deformation portion.

6. The method for manufacturing a spark plug (100) according to claim 4, wherein a subsequent pressing amount in step (e2) is determined based on a difference between the actual compressive deformation amount obtained in the step (e4) and a predetermined compressive deformation amount.

7. The method for manufacturing a spark plug according to claim 4, wherein the first pressure and the second pressure are equal to each other.

8. The method for manufacturing a spark plug according to claim 1, wherein the metal shell includes a threaded mounting portion to be mounted on an internal combustion engine, and the threaded mounting portion has a diameter of 12 mm or less.

9. The method for manufacturing a spark plug according to claim 1, wherein the metal shell includes a tool engaging portion having a hexagonal columnar shape for engaging a tool when the metal shell is being mounted on an internal combustion engine, and an opposite side distance of the tool engaging portion is 14 mm or less in length.

* * * * *